US009429325B2

(12) United States Patent
Shershnyov et al.

(10) Patent No.: US 9,429,325 B2
(45) Date of Patent: Aug. 30, 2016

(54) COMBUSTOR AND METHOD OF SUPPLYING FUEL TO THE COMBUSTOR

(75) Inventors: Borys Borysovych Shershnyov, Moscow (RU); Geoffrey David Myers, Simpsonville, SC (US); Leonid Yulyevich Ginesin, Moscow (RU)

(73) Assignee: General Electric Company, Schenectady, NY (US)

( * ) Notice: Subject to any disclaimer, the term of this patent is extended or adjusted under 35 U.S.C. 154(b) by 272 days.

(21) Appl. No.: 14/122,694

(22) PCT Filed: Jun. 30, 2011

(86) PCT No.: PCT/RU2011/000471

§ 371 (c)(1),
(2), (4) Date: Nov. 27, 2013

(87) PCT Pub. No.: WO2013/002666

PCT Pub. Date: Jan. 3, 2013

(65) Prior Publication Data

US 2014/0123671 A1 May 8, 2014

(51) Int. Cl.

| | |
|---|---|
| ***F23R 3/28*** | (2006.01) |
| ***F23R 3/34*** | (2006.01) |
| ***F23R 3/54*** | (2006.01) |
| ***F23R 3/14*** | (2006.01) |

(52) U.S. Cl.

CPC ..... *F23R 3/286* (2013.01); *F23R 3/14* (2013.01); *F23R 3/34* (2013.01); *F23R 3/343* (2013.01); *F23R 3/54* (2013.01)

(58) Field of Classification Search

CPC ..... F23R 3/286; F23R 3/12; F23R 3/14; F23R 3/34; F23R 3/343; F23R 3/346; F23R 3/54

USPC ..... 60/733, 734, 737, 738, 739, 743, 748

See application file for complete search history.

(56) References Cited

U.S. PATENT DOCUMENTS

| | | | |
|---|---|---|---|
| 2,922,279 | A | 1/1960 | Roberson et al. |
| 3,934,409 | A | 1/1976 | Quillevere et al. |
| 4,040,252 | A | 8/1977 | Mosier et al. |
| 4,045,956 | A | 9/1977 | Markowski et al. |
| 4,112,676 | A | 9/1978 | DeCorso |

(Continued)

FOREIGN PATENT DOCUMENTS

| | | |
|---|---|---|
| EP | 2236935 | 6/2010 |
| EP | 2206964 A2 | 7/2012 |

(Continued)

OTHER PUBLICATIONS

Co-pending U.S. Appl. No. 13/417,405, Chen at al., filed Mar. 12, 2012.

(Continued)

*Primary Examiner* — Steven Sutherland
(74) *Attorney, Agent, or Firm* — Dority & Manning, P.A.

(57) ABSTRACT

A combustor (10) includes a liner (12) that defines a combustion chamber (18) first pre-mix chamber (14) is upstream of the combustion chamber, and a fuel plenum (40) in fluid communication with the first pre-mix chamber surrounds a least a portion of the first pre-mix chamber. A method of supplying a fuel to combustor includes flowing the fuel over an outer surface of a first pre-mix chamber and into the first pre-mix chamber.

15 Claims, 5 Drawing Sheets

(56) References Cited

U.S. PATENT DOCUMENTS

| | | | | |
|---|---|---|---|---|
| 4,253,301 | A | 3/1981 | Vogt | |
| 4,260,367 | A * | 4/1981 | Markowski | F23R 3/346 431/158 |
| 4,288,980 | A | 9/1981 | Ernst | |
| 4,701,124 | A * | 10/1987 | Maghon | F02C 3/30 431/183 |
| 4,928,481 | A | 5/1990 | Joshi et al. | |
| 5,054,280 | A | 10/1991 | Ishibashi et al. | |
| 5,099,644 | A | 3/1992 | Sabla et al. | |
| 5,127,229 | A | 7/1992 | Ishibashi et al. | |
| 5,297,391 | A | 3/1994 | Roche | |
| 5,321,948 | A | 6/1994 | Leonard | |
| 5,450,725 | A | 9/1995 | Takahara et al. | |
| 5,623,819 | A | 4/1997 | Bowker et al. | |
| 5,749,219 | A | 5/1998 | DuBell | |
| 5,974,781 | A | 11/1999 | Correa et al. | |
| 6,047,550 | A | 4/2000 | Beebe | |
| 6,161,387 | A * | 12/2000 | Green | F23R 3/343 60/742 |
| 6,178,737 | B1 | 1/2001 | Lenertz et al. | |
| 6,192,688 | B1 | 2/2001 | Beebe | |
| 6,253,538 | B1 | 7/2001 | Sampath et al. | |
| 6,367,262 | B1 * | 4/2002 | Mongia | F23R 3/14 60/748 |
| 6,453,660 | B1 * | 9/2002 | Johnson | F23C 99/00 60/39.821 |
| 6,868,676 | B1 | 3/2005 | Haynes | |
| 6,925,809 | B2 | 8/2005 | Mowill | |
| 6,935,116 | B2 | 8/2005 | Stuttaford et al. | |
| 7,137,256 | B1 | 11/2006 | Stuttaford et al. | |
| 7,162,875 | B2 | 1/2007 | Fletcher et al. | |
| 7,237,384 | B2 | 7/2007 | Stuttaford et al. | |
| 7,425,127 | B2 | 9/2008 | Zinn | |
| 7,434,401 | B2 * | 10/2008 | Hayashi | F23D 11/107 60/743 |
| 7,665,309 | B2 | 2/2010 | Parker et al. | |
| 8,475,160 | B2 | 7/2013 | Campbell et al. | |
| 2005/0095542 | A1 | 5/2005 | Sanders et al. | |
| 2005/0097889 | A1 | 5/2005 | Pilatis et al. | |
| 2007/0022758 | A1 | 2/2007 | Myers et al. | |
| 2007/0137207 | A1 | 6/2007 | Mancini et al. | |
| 2008/0083224 | A1 * | 4/2008 | Varatharajan | F23R 3/14 60/748 |
| 2009/0084082 | A1 | 4/2009 | Martin et al. | |
| 2010/0018208 | A1 | 1/2010 | Ritland | |
| 2010/0018209 | A1 | 1/2010 | Ramier et al. | |
| 2010/0174466 | A1 | 7/2010 | Davis, Jr. et al. | |
| 2011/0056206 | A1 | 3/2011 | Wiebe | |
| 2011/0067402 | A1 | 3/2011 | Wiebe et al. | |
| 2011/0131998 | A1 | 6/2011 | Nadkarni et al. | |
| 2011/0179803 | A1 | 7/2011 | Berry et al. | |
| 2011/0296839 | A1 | 12/2011 | Van Nieuwenhuizen et al. | |
| 2013/0008169 | A1 | 1/2013 | Belsom et al. | |

FOREIGN PATENT DOCUMENTS

| | | |
|---|---|---|
| EP | 2613082 | 10/2013 |
| JP | 2006138566 | 6/2006 |
| WO | WO 2004/035187 A2 | 4/2004 |

OTHER PUBLICATIONS

Co pending U.S. Appl. No. 13/349,886, Stoia, et al., filed Jan. 13, 2012.

Co-pending U.S. Appl. No. 13/344,877, Stole, et al., filed Jan. 6, 2012.

Co-pending U.S. Appl. No. 13/349,906, Stoia, et al., filed Jan. 13, 2012.

Co-pending U.S. Appl. No. 13/420,715, Chen, et al., filed Mar. 15, 2012.

Co-pending U.S. Appl. No. 13/455,429, Romig, et al., filed Apr. 25, 2012.

Co-pending U.S. Appl. No. 13/455,480. Stoia, et al., filed Apr. 25, 2012.

Co-pending U.S. Appl. No. 14/122,697, Shershnyov, filed Nov. 27, 2013.

Co-pending U.S. Appl. No. 13/466,184, Melton, et al. filed May 08, 2012.

PCT International Written Opinion and Search Report for application PCT/RU2011/000471, dated Mar. 28, 2012.

* cited by examiner

COMBUSTOR AND METHOD OF SUPPLYING FUEL TO THE COMBUSTOR

FIELD OF THE INVENTION

The present invention generally involves a combustor and method for supplying fuel to the combustor.

BACKGROUND OF THE INVENTION

Gas turbines are widely used in industrial and power generation operations. A typical gas turbine may include an axial compressor at the front, one or more combustors around the middle, and a turbine at the rear. Ambient air enters the compressor, and rotating blades and stationary vanes in the compressor progressively impart kinetic energy to the air to produce a compressed working fluid at a highly energized state. The compressed working fluid exits the compressor and flows through nozzles in the combustors where it mixes with fuel and ignites to generate combustion gases having a high temperature and pressure. The combustion gases expand in the turbine to produce work. For example, expansion of the combustion gases in the turbine may rotate a shaft connected to a generator to produce electricity.

It is widely known that the thermodynamic efficiency of a gas turbine increases as the operating temperature, namely the combustion gas temperature, increases. However, if the fuel and air are not evenly mixed prior to combustion, localized hot spots may form in the combustor. The localized hot spots may increase the production of undesirable NOx emissions and may increase the chance for the flame in the combustor to flash back into the nozzles and/or become attached inside the nozzles which may damage the nozzles. Although flame flash back and flame holding may occur with any fuel, they occur more readily with high reactive fuels, such as hydrogen, that have a higher burning rate and a wider flammability range.

A variety of techniques exist to allow higher operating temperatures while minimizing NOx emissions, flash back, and flame holding. Many of these techniques seek to reduce localized hot spots to reduce the production of NOx and/or reduce low flow zones to prevent or reduce the occurrence of flash back or flame holding. For example, continuous improvements in nozzle designs result in more uniform mixing of the fuel and air prior to combustion to reduce or prevent localized hot spots from forming in the combustor. Alternately, or in addition, nozzles have been designed to ensure a minimum flow rate of fuel and/or air through the nozzle to cool the nozzle surfaces and/or prevent the combustor flame from flashing back into the nozzle. However, the improved nozzle designs typically result in increased manufacturing costs and/or continued additional parts or components added to the combustor that increase the differential pressure across the combustor, thus detracting from the overall efficiency of the gas turbine. Therefore, improvements in combustor designs to enhance the mixing of fuel and air prior to combustion and/or cool the combustor surfaces would be useful.

BRIEF DESCRIPTION OF THE INVENTION

Aspects and advantages of the invention are set forth below in the following description, or may be obvious from the description, or may be learned through practice of the invention.

One embodiment of the present invention is a combustor that includes a liner that defines a combustion chamber. A first pre-mix chamber is upstream of the combustion chamber, and a fuel plenum in fluid communication with the first pre-mix chamber surrounds at least a portion of the first pre-mix chamber.

In another embodiment of the present invention, a combustor includes a liner that defines a combustion chamber. A first pre-mix chamber is upstream of the combustion chamber, and a second pre-mix chamber circumferentially surrounds the first pre-mix chamber. An air plenum surrounds at least a portion of the second pre-mix chamber and is in fluid communication with the first pre-mix chamber.

The present invention also includes a method of supplying a fuel to a combustor. The method includes flowing the fuel over an outer surface of a first pre-mix chamber and into the first pre-mix chamber.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
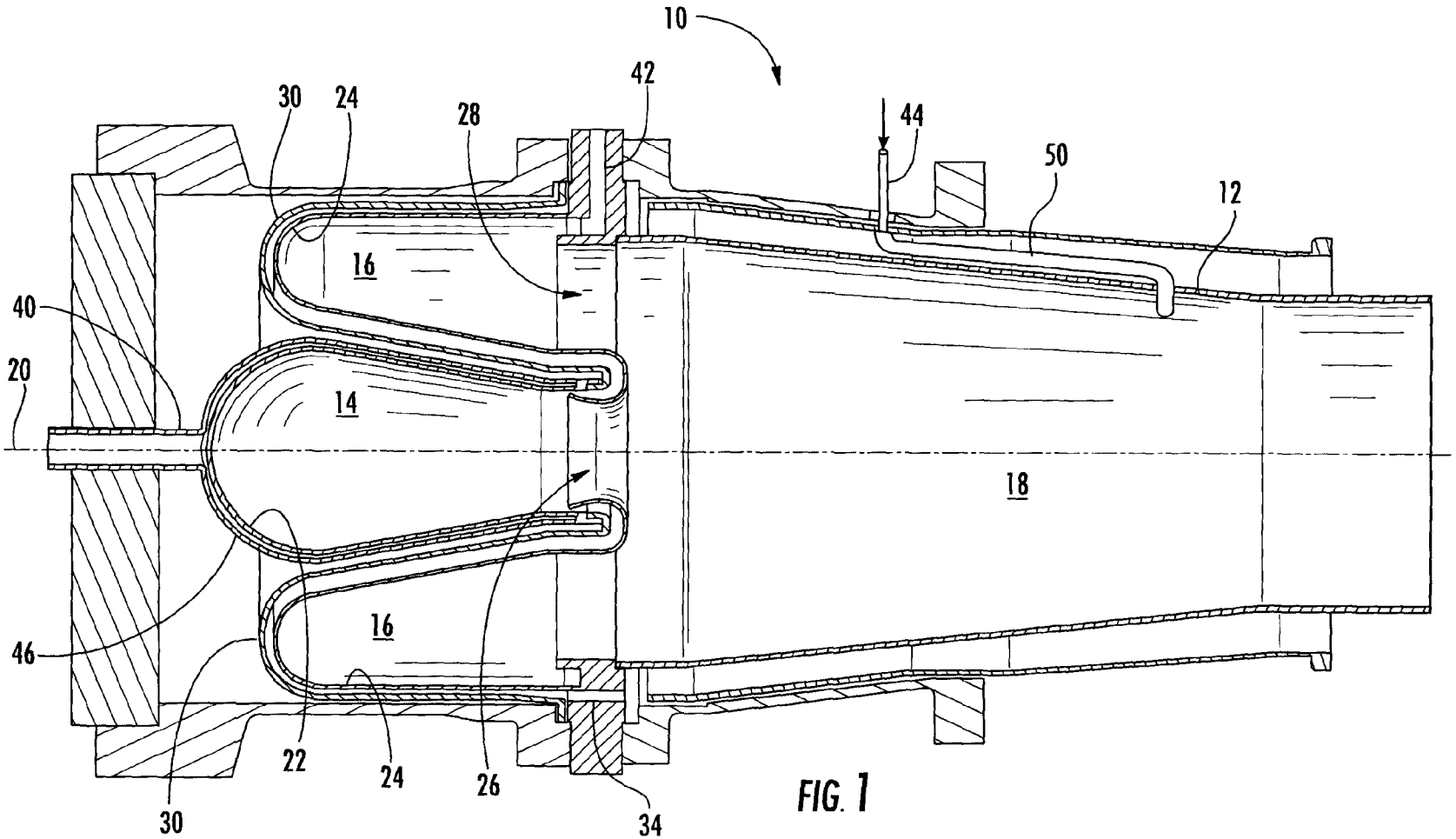
FIG. 1 is a simplified side cross-section view of a combustor according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a combustor design that enhances the mixing of fuel and air prior to combustion and/or reduces the combustor surface temperatures and/or peak combustion gas temperatures. In particular embodiments, the combustor may include one or more pre-mix chambers that enhance the mixing of the fuel and air prior to combustion. Alternately, or in addition, the combustor may flow fuel over or around the outside surface of the pre-mix chambers to remove heat therefrom. As a result, the combustor may be capable of extended turndown operations without exceeding emissions limits, may have enhanced safety margins in the event of a flame holding or flash back occurrence, may have longer intervals between preventative and/or corrective maintenance, and/or may be capable of operating with liquid or gaseous fuels.

FIG. 1 provides a simplified side cross-section view of a combustor 10 according to one embodiment of the present invention. As shown, the combustor 10 generally includes a liner 12 and first and second pre-mix chambers 14, 16. The liner 12 forms a generally cylindrical or tapered cylindrical pathway through the combustor 10 to define a combustion chamber 18. The liner 12 may be rolled and welded, forged, or cast from suitable materials capable of continuous exposure to the maximum anticipated temperatures associated with the combustion gases produced by the combustor 10. For example, the liner 12 may be made from a steel alloy or superalloy such as Inconel or Rene. The liner 12 and/or the second pre-mix chamber 16 may include a thermal barrier coating on the internal surface to further enhance heat resistance. The first and second pre-mix chambers 14, 16 are located upstream from the liner 12 to provide a sufficient volume in which the fuel and air may mix before combusting. As used herein, the terms "upstream" and "downstream" refer to the relative location of components in a fluid pathway. For example, component A is upstream of component B if a fluid flows from component A to component B. Conversely, component B is downstream of component A if component B receives a fluid flow from component A.

Figure 2:
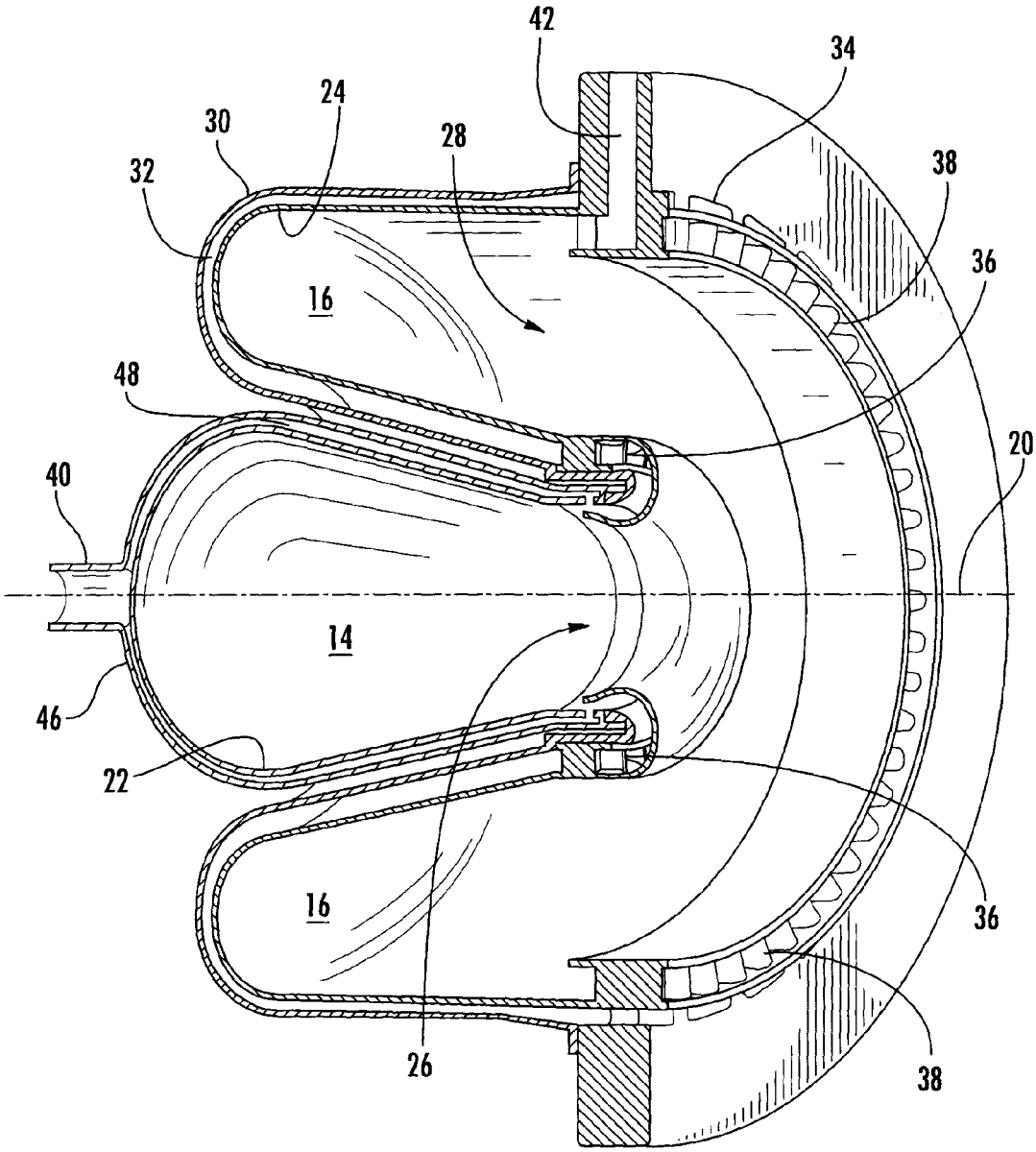
FIG. 2 is an upstream perspective partial cut-away view of the pre-mix chambers shown in FIG. 1.
Figure 3:
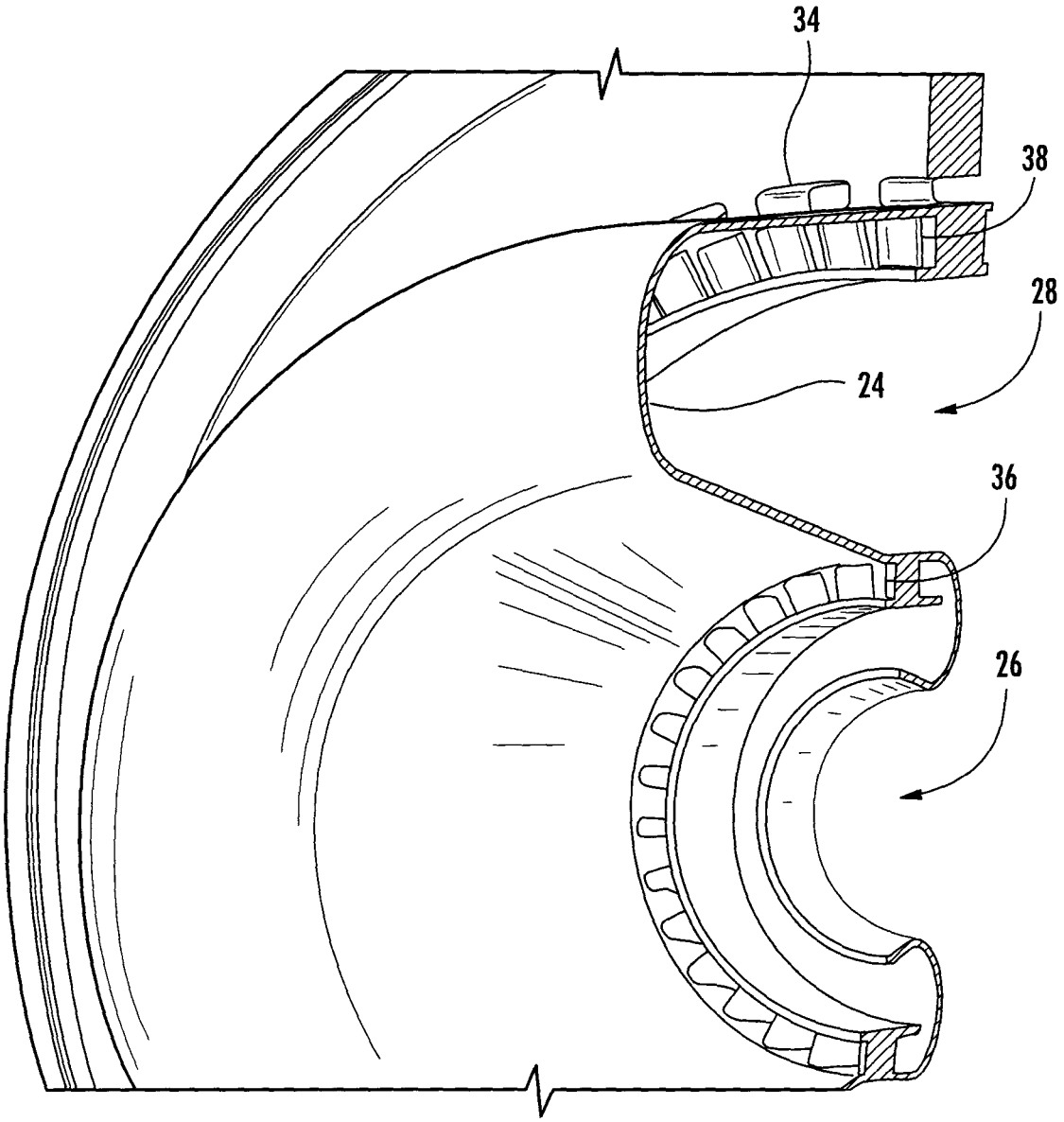
FIG. 3 is downstream perspective partial cut-away view of the pre-mix chambers shown in FIG. 1.

FIGS. 2 and 3 provide upstream and downstream perspective partial cut-away views of the pre-mix chambers 14, 16 shown in FIG. 1. As shown, the first pre-mix chamber 14 is generally aligned with an axial centerline 20 of the combustor 10, and the second pre-mix chamber 16 circumferentially surrounds the first pre-mix chamber 14. For example, the second pre-mix chamber 16 may be a toroid that surrounds the first pre-mix chamber 14. Each pre-mix chamber 14, 16 generally includes an inner wall 22, 24 that defines a cavity and an exhaust 26, 28 for each respective chamber 14, 16. The cavity may be curved to minimize low flow regions and promote mixing of the fuel and air in the pre-mixed chambers 14, 16. Each exhaust 26, 28 is generally adjacent to the combustion chamber 18 so that fuel and air may more completely mix in the respective pre-mix chambers 14, 16 before flowing into the combustion chamber 18. In the particular embodiment shown in FIGS. 1, 2, and 3, the inner wall 24 of the second pre-mix chamber 16 curves around to form the exhaust 26 of the first pre-mix chamber 14.

A compressed working fluid (e.g., air from a compressor) flows to and through the first and second pre-mix chambers 14, 16 through slightly different paths. Specifically, as shown most clearly in FIGS. 2 and 3, an outer wall 30 adjacent to or surrounding the inner wall 24 of the second pre-mix chamber 16 may define an air plenum 32 around at least a portion of the second pre-mix chamber 16. Air ports 34 circumferentially spaced around the liner 12 allow the compressed working fluid to flow into and through the air plenum 32 to remove heat from the outer surface of the second pre-mix chamber 16 before entering the first pre-mix chamber 14. In particular embodiments, the compressed working fluid may flow over a plurality of first swirler vanes 36 circumferentially arranged around the exhaust 26 of the first pre-mix chamber 14 before entering the first pre-mix chamber 14. Similarly, the combustor 10 may include a plurality of second swirler vanes 38 circumferentially arranged around the exhaust 28 and/or first swirler vanes 36, and the compressed working fluid may flow over the second swirler vanes 38 before directly entering the second pre-mix chamber 16. The first and second swirler vanes 36, 38 may be curved or angled with respect to the axial centerline 20 to impart tangential velocity to the air flowing over the swirler vanes.

The combustor 10 may further include one or more fuel plenums that supply fuel for combustion. For example, as best shown in FIGS. 1 and 2, the combustor 10 may include first, second, and third fuel plenums 40, 42, 44. The first fuel plenum 40 may comprise a supply of fuel in fluid communication with the first pre-mix chamber 14. For example, an outer wall 46 adjacent to or surrounding the inner wall 22 of the first pre-mix chamber 14 may define a passage 48 around the inner wall 22 that connects the first fuel plenum 40 to the first pre-mix chamber 14. In this manner, at least a portion of the first fuel plenum 40 may surround at least a portion of the first pre-mix chamber 14 so that fuel may flow over the inner wall 22 to remove heat from the outer surface of the first pre-mix chamber 14 before entering the first pre-mix chamber 14. After entering the first pre-mix chamber 14, the fuel from the first fuel plenum 40 mixes with the compressed working fluid flowing over the first swirler vanes 36 before exiting the first pre-mix chamber 14 through the exhaust 26 and igniting in the combustion chamber 18. In the event that the combustion flame flashes back into the first pre-mix chamber 14, the fuel from the first fuel plenum 40 flowing around the first pre-mix chamber 14 prevents the inner wall 22 of the first pre-mix chamber 14 from overheating.

The second fuel plenum 42 may comprise an annular fuel manifold surrounding the combustor 10 in fluid communication with the second pre-mix chamber 16. Fuel from the second fuel plenum 42 may flow through metering ports in the second swirler vanes 38 directly into the second pre-mix chamber 16. In this manner, the fuel from the second fuel plenum 42 mixes with the compressed working fluid flowing over the second swirler vanes 38. Combustion of the fuel-air mixture in the second pre-mix chamber 16 occurs anywhere from inside the second pre-mix chamber 16 to downstream of the second pre-mix chamber 16 in the combustion chamber 18, depending on the operating level of the particular combustor 10.

The third fuel plenum 44 may similarly comprise an annular fuel manifold surrounding the combustor 10 in fluid communication with the combustion chamber 18. Fuel from the third fuel plenum 44 may flow into a fuel injector 50 that mixes the fuel with the compressed working fluid and injects the mixture through the liner 12 and into the combustion chamber 18. In this manner, at least a portion of the third fuel plenum 44 may surround at least a portion of the liner 12 so that fuel may flow over the liner 12 to remove heat from the outer surface of the liner 12 before entering the combustion chamber 18.

Figure 4:
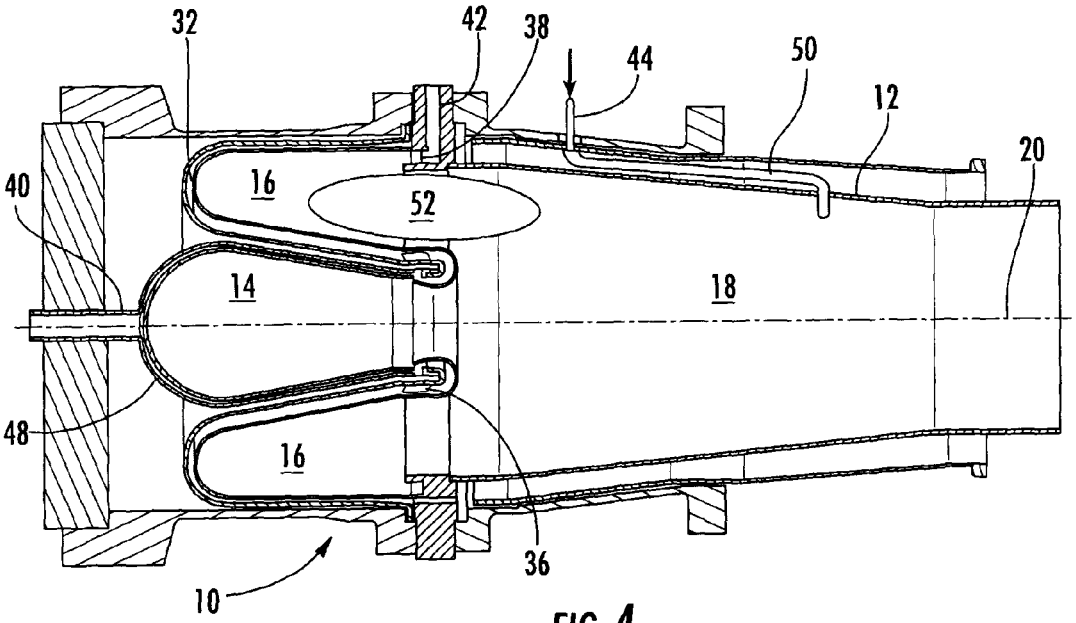
FIG. 4 is a simplified side cross-section view of the combustor shown in FIG. 1 during ignition or turndown operations.

The multiple pre-mix chambers 14, 16 and multiple fuel plenums 40, 42, 44 provide wide flexibility and multiple operating schemes for the combustor 10 without exceeding emissions limits and/or peak operating temperatures. For example, FIG. 4 provides a simplified side cross-section view of the combustor 10 during ignition or turndown operations. In this particular operating scheme, no fuel is supplied through either the first or third fuel plenums 40, 44, and fuel is only supplied from the second fuel plenum 42 to the second pre-mix chamber 16. As a result, the fuel and air flows over the plurality of second swirler vanes 38 before entering and mixing in the second pre-mix chamber 16. As shown in FIG. 4, the mass flow rate and velocity of the fuel-air mixture flowing through the exhaust 28 of the second pre-mix chamber 16 maintains a first flame 52 in the general vicinity of the exhaust 28, with the precise location of the first flame 52 dependent on the actual power level of the combustor 10 at ignition or during turndown.

Figure 5:
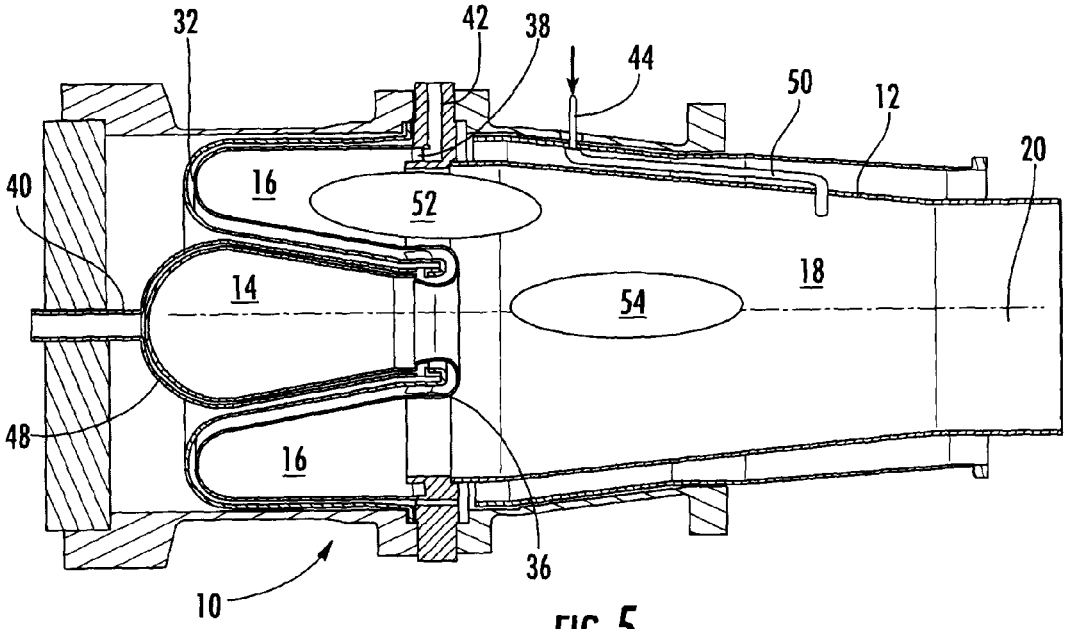
FIG. 5 is a simplified side cross-section view of the combustor shown in FIG. 1 during partial load operations.

FIG. 5 shows the combustor 10 being operated during partial load operations. During partial load operations, the second fuel plenum 42 supplies fuel through the second swirler vanes 38 to the second pre-mix chamber 16. In addition, the first fuel plenum 40 supplies fuel through the passage 48 to the first pre-mix chamber 14 in one or more combustors 10 included in the gas turbine, with the number of combustors 10 receiving fuel from the first fuel plenum 40 dependent on the actual power level of the gas turbine. As in FIG. 4, the mass flow rate and velocity of the fuel-air mixture flowing through the exhaust 28 of the second pre-mix chamber maintains the first flame 52 in the general vicinity of the exhaust 28. In addition, the mass flow rate and velocity of the fuel-air mixture flowing through the exhaust 26 of the first pre-mix chamber 14 maintains a second flame 54 downstream of the first flame 52 in the combustion chamber 18, with the precise location dependent on the actual power level of the combustor 10.

Figure 6:
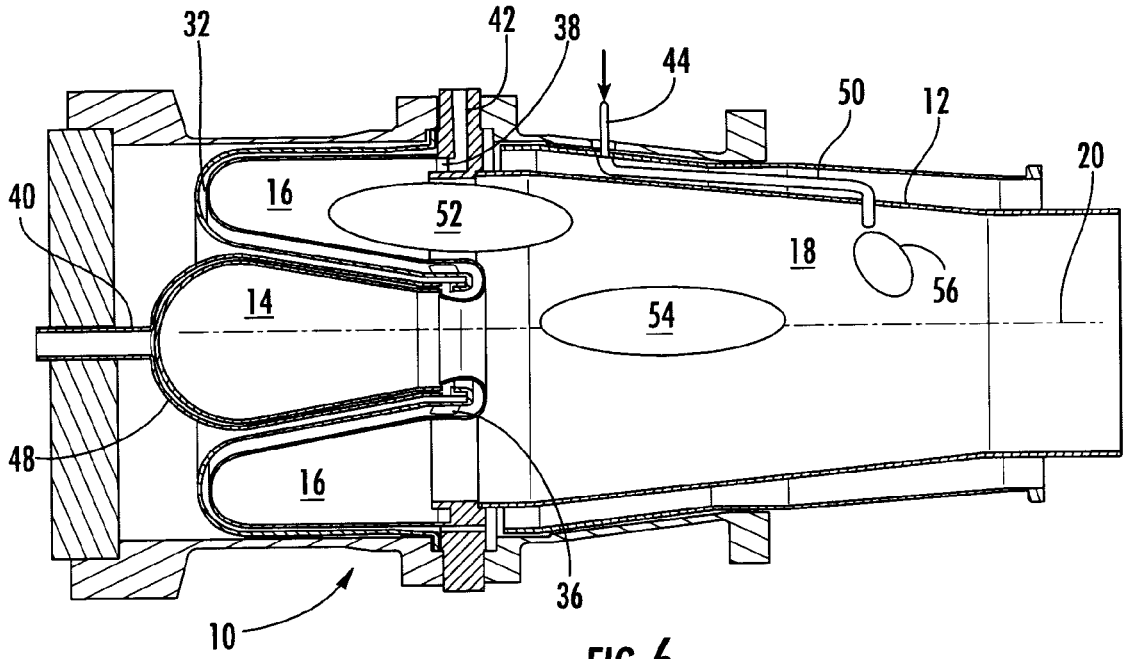
FIG. 6 is a simplified side cross-section view of the combustor shown in FIG. 1 during full load operations.

FIG. 6 shows the combustor 10 being operated during full load operations. In this particular operating scheme, the first, second, and third fuel plenums 40, 42, 44 each supply fuel for combustion. Specifically, the first fuel plenum 40 supplies fuel through the passage 48 to the first pre-mix chamber 14, and the second fuel plenum 42 supplies fuel through the second swirler vanes 38 to the second pre-mix chamber 16, as previously described with respect to FIG. 5. In addition, the third fuel plenum 44 supplies fuel to mix with air in the fuel injector 50 before being injected through the liner 12 directly into the combustion chamber 18, creating a third flame 56 in the combustion chamber 18.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A combustor comprising:

a. a liner, wherein the liner defines a combustion chamber;

b. a first pre-mix chamber upstream of the combustion chamber;

c. a fuel plenum in fluid communication with the first pre-mix chamber, wherein the fuel plenum surrounds at least a portion of the first pre-mix chamber;

d. a second pre-mix chamber circumferentially surrounding the first pre-mix chamber; and e. an air plenum surrounding at least a portion of the second pre-mix chamber in a configuration so as to direct compressed air around the second pre-mix chamber prior to the compressed air exiting the air plenum and entering the first pre-mix chamber at a downstream exhaust end of the first pre-mix chamber.

2. The combustor as in claim 1, further comprising a plurality of first swirler vanes circumferentially arranged around the downstream exhaust end of the first pre-mix chamber.

3. The combustor as in claim 2, further comprising a plurality of second swirler vanes circumferentially arranged around the plurality of first swirler vanes.

4. The combustor as in claim 1, wherein the second pre-mix chamber comprises an inner wall and wherein the inner wall defines the downstream exhaust end for the first pre-mix chamber.

5. The combustor as in claim 1, further comprising a fuel injector in fluid communication with the combustion chamber through the liner.

6. A combustor comprising:

a. a liner, wherein the liner defines a combustion chamber;

b. a first pre-mix chamber upstream of the combustion chamber;

c. a fuel plenum in fluid communication with the first pre-mix chamber, wherein the fuel plenum surrounds at least a portion of the first pre-mix chamber;

d. a second pre-mix chamber circumferentially surrounding the first pre-mix chamber; and e. an air plenum surrounding at least a portion of the second pre-mix chamber and in fluid communication with the first pre-mix chamber, wherein the second pre-mix chamber comprises an inner wall and an outer wall adjacent to the inner wall, wherein the inner and outer walls define the air plenum surrounding the portion of the second pre-mix chamber.

7. A combustor comprising:

a. a liner, wherein the liner defines a combustion chamber;

b. a first pre-mix chamber upstream of the combustion chamber;

c. a second pre-mix chamber circumferentially surrounding the first pre-mix chamber; and d. an air plenum surrounding at least a portion of the second pre-mix chamber and in fluid communication with the first pre-mix chamber, wherein the air plenum is configured to direct compressed air from an exhaust end of the second pre-mix chamber, around the second pre-mix chamber, and into an exhaust end of the first pre-mix chamber.

8. The combustor as in claim 7, further comprising a plurality of first swirler vanes circumferentially arranged around the exhaust end of the first pre-mix chamber.

9. The combustor as in claim 8, further comprising a plurality of second swirler vanes circumferentially arranged around the plurality of first swirler vanes.

10. The combustor as in claim 7, wherein the second pre-mix chamber comprises an inner wall and wherein the inner wall defines the exhaust end for the first pre-mix chamber.

11. The combustor as in claim 7, wherein the second pre-mix chamber comprises an inner wall and an outer wall adjacent to the inner wall, wherein the inner and outer walls define the air plenum surrounding the portion of the second pre-mix chamber.

12. The combustor as in claim 7, further comprising a fuel injector in fluid communication with the combustion chamber through the liner.

13. A method of supplying a fuel to a combustor comprising:

a. flowing the fuel over an outer surface of a first pre-mix chamber and into the first pre-mix chamber; and b. flowing compressed air over an outer surface of a second pre-mix chamber that circumferentially surrounds the first pre-mix chamber prior to directing the compressed air into the first pre-mix chamber at a downstream end of the first pre-mix chamber.

14. The method as in claim 13, further comprising flowing the fuel into the second pre-mix chamber surrounding the first pre-mix chamber.

15. The method as in claim 13, further comprising flowing the fuel into a combustion chamber downstream of the first pre-mix chamber.

* * * * *